United States Patent [19]

Jones

[11] 3,982,573

[45] Sept. 28, 1976

[54] ELASTIC STORAGE TANK AND METHOD FOR MAKING THE SAME

[75] Inventor: Walter C. Jones, Armstrong, Iowa

[73] Assignee: Rubber Dynamics Corporation, Armstrong, Iowa

[22] Filed: July 10, 1975

[21] Appl. No.: 594,692

Related U.S. Application Data

[62] Division of Ser. No. 478,738, June 12, 1974, Pat. No. 3,919,030.

[52] U.S. Cl. ..... 150/.5; 150/1

[51] Int. Cl.[2] ..... A45C 11/00

[58] Field of Search ..... 150/.5, 1; 229/41 R, 229/41 B, 53; 5/337; 156/198, 211, 227, 258, 304, 263

[56] References Cited

UNITED STATES PATENTS

| | | | |
|---|---|---|---|
| 2,724,418 | 11/1955 | Krupp | 150/.5 |
| 3,251,075 | 5/1966 | Saltness | 5/337 |
| 3,453,164 | 7/1969 | Gursky | 156/198 |

*Primary Examiner*—Ro E. Hart

*Attorney, Agent, or Firm*—Williamson, Bains & Moore

[57] ABSTRACT

An elastic, fluid-impervious storage tank includes a pair of end tank sections and intermediate tank sections, the latter being provided an inlet or filler pipe. Each end section is formed from a single blank of a fiber-reinforced elastomer which is cut and folded so that the corner portions thereof are of rounded configuration.

1 Claim, 3 Drawing Figures

ELASTIC STORAGE TANK AND METHOD FOR MAKING THE SAME

This is a division of application Ser. No. 478,738, filed June 12, 1974, now U.S. Pat. No. 3,919,030.

SUMMARY OF THE INVENTION

This invention relates to an elastic storage tank and method of making the same.

Elastic type storage tanks have been commercially developed, but most of these tanks are of very large capacity, although there are some small elastic storage receptacles presently available. Because of the location of the tank, it is often desirable to construct the tank generally of rectangular shape. Most of the prior art elastic tanks are not of rectangular configuration, and those tanks that are rectangularly shaped have angular corners. It will be appreciated that angular corner portions in these prior art elastic tanks is structurally less efficient than arcuate corner portions.

It is therefore a general object of this invention to provide an elastic storage tank of small and intermediate sizes, and a method of making the same, wherein the tank in a nondistended condition is of generally rectangular configuration, but is provided with arcuate corner portions. In carrying out the present method, each tank is comprised of a pair of end sections each being formed from a single blank of a fluid impervious elastomer. The blanks are cut and folded and certain edges thereof are sealingly secured together to permit each blank to be quickly formed into a generally rectangular shaped end section having arcuate corner portions. The end sections are then secured together or to an intermediate section to form the completed tank. Thus through present novel methods, a generally rectangular shaped tank may be readily formed which has rounded corner portions and which can withstand greater stresses than any heretofore mentioned prior art storage tanks.

These and other objects and advantages of this invention will more fully appear from the following description made in connection with the accompanying drawings wherein like reference characters refer to the same or similar parts throughout the several views.

FIGURES OF THE DRAWINGS

DESCRIPTION OF THE PREFERRED EMBODIMENT OF THE INVENTION

Figure 1:
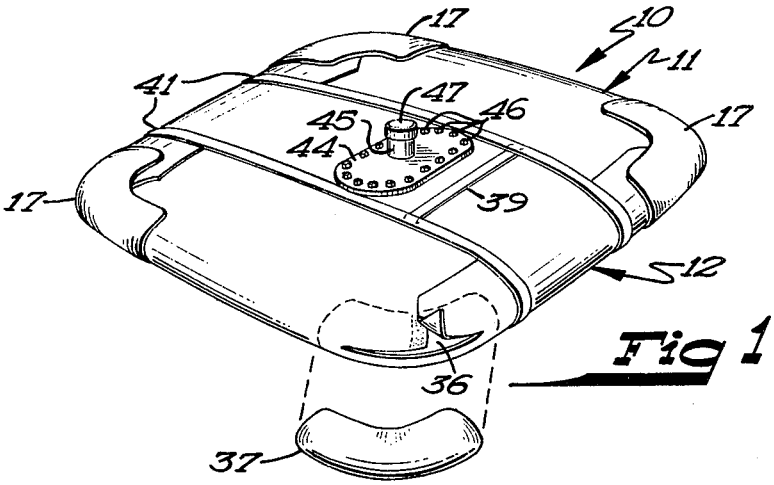
FIG. 1 is a perspective view of the novel tank with certain parts thereof removed in an exploded fasion for clarity.
Figure 2:
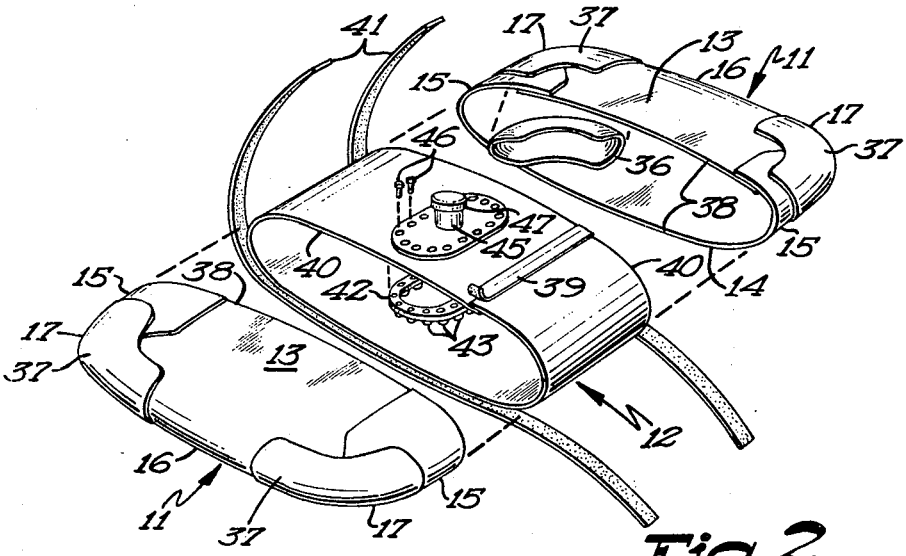
FIG. 2 is an exploded perspective view illustrating the various components of applicant's novel tank.
Figure 3:
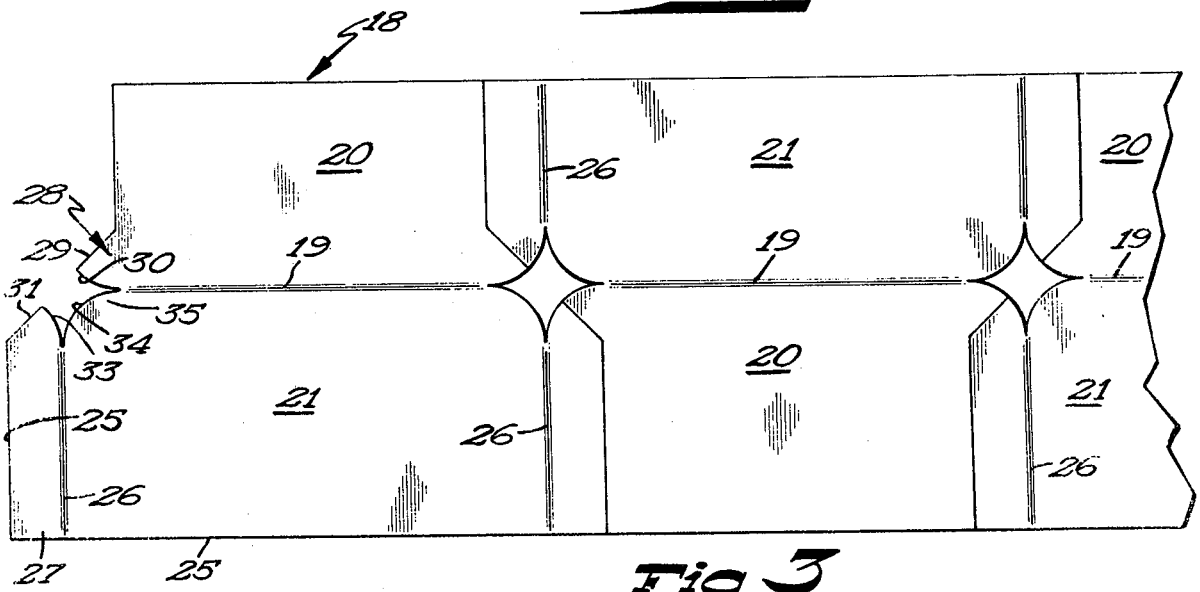
FIG. 3 is an elevational view of the end tank section blanks, and illustrating the manner in which the blanks are cut from a sheet of material.

Referring now to the drawing, and more specifically to the FIG. 1, it will be seen that one embodiment of my novel flexible tank, designated generally by the reference numeral 10 is there shown. The tank 10 is comprised of a pair of end tank sections 11, interconnected to an intermediate tank section 12. According to the present method of making the elastic tank 10, the intermediate tank section 12 and each of the end tank sections are constructed separately and are then joined together to form the completed tank which, as shown, is of generally rectangular or parallelpiped configuration, but having rounded corner portions. Referring now to FIG. 2, it will be noted that each end tank section 11 is comprised of an upper wall portion 13, a bottom wall portion 14, opposed side wall portions 15, and an end wall portion 16. It will further be noted that each end tank section 11 has corner portions 17 which are of generally arcuate or rounded configuration.

Each end tank section 11 is formed from a single blank 18 of a fiber-reinforced fluid impervious elastomer. It will be noted that each blank 18 is of generally rectangular configuration having substantially straight parallel longitudinal edges, but having transverse edges which are offset. Thus, as each successive cut is made by the cutting die, the roll or sheet of material from which the blanks 18 are cut is turned over so that the longitudinal edges of the sheet of material are reversed 180° for each successive cut. This permits the cutting step to be successively made without changing the position of the cutting die, and also results in a substantial saving of material since there is little loss of waste during the cutting steps.

Each blank 18 is first folded along a folded line 19 to form the blank 18 into a substantially rectangular shaped panel 20 and a rectangular shaped panel 21. The fold line 19 actually constitutes the longitudinal center line for the blank and is equally spaced from the longitudinal edge 22 of the panel 20 and the longitudinal edge 24 of the panel 21. The panel 20 also includes transverse edge portions 23 while the panel 21 includes transverse edge portions 25 which are offset laterally outwardly from the edges 23. The panel 21 is also folded along a pair of transverse fold lines 26 adjacent opposite ends thereof, to thereby form a pair of end panels 27 which are also of elongate generally rectangular configuration. It will be noted that the fold lines 26 are disposed substantially normal to the longitudinal edge 24.

The blank 18 is cut in a manner so that a panel 20 is provided with a pair of generally triangular shaped flaps 28 which project longitudinally of the blank 18, but laterally outwardly from the panel 20 adjacent the fold line 19. It will be noted that each flap 28 has a substantially straight edge portion 29 and an arcuate edge portion 30 which is cut on a predetermined radius.

Each of the end panels 27 is also provided with a generally triangular shaped flap 31 which projects transversely of the blank 18 but longitudinally from the end panel 27 and generally in a direction towards one of the flaps 28 on the panel 20. It will be noted that each triangular shaped flap 31 includes a straight edge portion 32 and an arcuate edge portion 33 which is cut on a predetermined radius. The panel 21 also includes a pair of arcuate edge portions 34, each cut on a predetermined radius and each extending between one of the flaps 31 on the end panel 27 and a flap 28 on panel 20. It will be noted that the radius for the arcuate edge portions 34 of the panel 21 is tangential to the fold line 26 and to the fold line 19.

A suitable adhesive material is applied to one surface of the arcuate edge portions 30 of the flaps 28, and the arcuate edge portions 34 of the panel 21, the arcuate edge portion and straight edge portion of each flap 31, and the longitudinal edge portions of each end panel 27. After the blank 18 is folded along fold line 19 and fold lines 26, edge portion 29 for each flap 28 will be disposed in lapped relation with respect to edge portions 32 of the associated flap 31. These edge portions will be secured together as best seen in FIG. 1, but a slit-like opening will remain at each corner portion and will be defined by edge portions 30, 33 and 34 respectively for each corner portion.

Means are provided for forming and closing each corner portion and this means includes a formed elongate arcuate inner attachment member 36 which is formed of a suitable elastomer and having it outer or convex surface coated with a suitable adhesive for sealing attachment to the inner surface of a corner portion to cover and close the opening therein. A formed elongate arcuate outer attachment member 37 is also provided for each corner portion and is formed of a suitable elastomer having its inner or concave surface coated with a suitable adhesive for sealing attachment to the outer surface of each corner portion. Since the inner and outer attachment members are preformed to an arcuate configuration, there is no inherent memory in these attachment members, thereby assuring that the corner portions will remain rounded or arcuate in configuration. The lapped construction of the corner portions as well as the provision of inner and outer attachment members, provides a very strong stress resistant structure.

The longitudinal edge 25 of each end panel will be disposed in overlying lapped relation with an edge portion 23 of the panel 20 and will be secured thereto by the adhesive applied to the edge portion 25. Each end tank section will then be completely formed and will have a closed end defined by the end wall portion 16 and an open end defined by a continuous peripheral edge 38. The intermediate tank section 12 is formed from a single elongate generally rectangular blank of the fiber-reinforced elastomer, the transverse edges of the blank being disposed in overlapped relation and secured together by a suitable adhesive and by sealing tapes 39 which overly and underly the lapped ends. Thus when the intermediate tank section is formed, it presents continuous peripheral end edges 40 at opposite ends thereof.

The inner peripheral edge 38 of each end tank section is disposed in overlapped relation with the peripheral end edges 40 of the intermediate tank section 12 and are sealingly joined thereto by suitable adhesive and by suitable elongate sealing tapes 41 to seal the end sections to the intermediate section.

Inlet or filler means are provided on the intermediate section and includes a generally oval metal ring 42 having a plurality of axially extending internally threaded bosses 43 integral therewith. The ring 42 is positioned against the inner surface of the intermediate tank section 12 and each of the internally threaded bosses 43 is disposed in registering relation with one of a plurality of apertures (not shown) in the intermediate section. A substantially flat oval plate 44 is positioned upon the exterior surface of the intermediate tank section, the plate having a plurality of spaced apart apertures in the marginal portions thereof, each being disposed in registering relation with one of the bosses 43 on the ring 42. Bolts 46 threadedly engage the bosses 43 and clamp the plate 44 and ring 42 on the intermediate tank section 12. The plate 42 is provided with a filler or inlet pipe 45 which projects upwardly or outwardly therefrom, the pipe communicating with an opening in the intermediate tank to permit filling or evacuation of the tank. A closure cap 47 is releasably secured to the upper end of the inlet pipe 45 to permit the inlet pipe to be closed in sealing relation.

In some intances, the two end tank sections may be joined together directly by a suitable adhesive and sealing tapes. When a tank is so constructed, one end section will be provided with an inlet structure. It is also pointed out that a tank may be constructed from a single blank of material using the principles of my novel method, the blank having four sets of corner flaps for formation of the rounded corner portions.

From the foregoing, it will be noted that I have provided a novel elastic storage tank, which is of generally rectangular or parallelepiped configuration but which is provided with rounded arcuate corners, a structural feature that greatly increases the strength of the tank. The novel method employed in making the tank permits ready fabrication of the tank with a minimum of effort and labor, and with a minimum of loss of material during the blank forming steps.

My novel storage tank is especially adapted for use in storing fluids such as water, chemicals and especially fuels such as gasoline or the like. When the tank is used as a fuel storage receptacle, the flexible elastic properties of the tank cause the tank to continuously collapse as it is evacuated so that the interior of the tank has little, if any, volumetric space in which volatile vapors may accummulate. The tank is therefore ideal for storing volatile fuels such as gasoline since the tank remains in a substantially full condition as the fuel is evacuated.

My novel tank can also be used to store particulate or pulverulent materials such as grain, flour, sugar or the like. In this regard, the tank will be provided with an outlet through which the particulate material is removed, and a user may introduce air under pressure through the inlet to assist the removal of the particulate material in a fluidized stream of air.

Thus it will be seen that I have provided a novel elastic storage tank which is not only of simple and inexpensive construction, but one which functions in a more efficient manner than any heretofore known comparable device.

What is claimed is:

1. An elastic storage tank for fluid or fluid-like material comprising;

a pair of substantially identical end tank sections, each being formed from a single blank of a fiber-reinforced elastomer, each end tank section including upper and lower wall portions, each being defined by a pair of panels formed by folding the blank along a longitudinal fold line, each end tank section including side wall portions extending between and being joined with said upper and lower wall portions, said side wall portions being defined by elongate end panels which are formed by folding one of the upper or lower wall-defining panels along transverse fold lines adjacent opposite ends of said last-mentioned wall-defining panel, each side wall portion having a triangular flap, and the other of said upper and lower wall portions having a pair of generally triangular shaped flaps, each projecting therefrom and overlapping and being sealingly secured to one of said flaps on a side wall portion, said one upper or lower wall portions having arcuate edge portions, each located between a flap on a side wall portion and a flap on the other upper or lower wall portion, a pair of formed arcuate attachment members, each being sealingly secured to the lapped flaps on a side wall portion and on the other of said upper or lower wall portions, and to an arcuate edge portion of said one of the upper or lower wall portions, and means sealingly securing the end tank sections together.

* * * * *